United States Patent [19]

East et al.

[11] Patent Number: 4,732,551

[45] Date of Patent: Mar. 22, 1988

[54] CONTINUOUS EXTRUSION OF METALS

[75] Inventors: John East, Wantage, United Kingdom; Ian Maxwell, Reading, England

[73] Assignee: Metal Box Public Limited Company, United Kingdom

[21] Appl. No.: 828,752

[22] Filed: Feb. 11, 1986

Related U.S. Application Data

[63] Continuation-in-part of Ser. No. 574,514, Jan. 27, 1984, abandoned.

[30] Foreign Application Priority Data

Feb. 3, 1983 [GB] United Kingdom ..... 8302951
Apr. 12, 1983 [GB] United Kingdom ..... 8309836

[51] Int. Cl.[4] ..... B22F 3/02; B21C 23/01

[52] U.S. Cl. ..... 425/79; 72/262; 419/67; 425/376 A; 425/376 B

[58] Field of Search ..... 72/10, 13, 47, 264, 72/268, 262; 425/79, 806 R, 224, 294, 311, 376 A, 376 B; 264/176 C, 161, 163, 176.1; 419/67

[56] References Cited

U.S. PATENT DOCUMENTS

| | | | |
|---|---|---|---|
| 3,488,416 | 1/1970 | Rothschild | 264/176 C |
| 4,044,587 | 8/1977 | Green et al. | 425/374 |
| 4,054,048 | 10/1977 | Hagerman | 72/262 |
| 4,065,950 | 1/1978 | Green et al. | 72/262 |
| 4,101,253 | 7/1978 | Etherington | 72/262 |
| 4,189,291 | 2/1980 | Longhi | 425/374 |
| 4,283,931 | 8/1981 | Pigott et al. | 72/262 |
| 4,362,485 | 12/1982 | Slater et al. | 425/79 |
| 4,397,622 | 8/1983 | Childs et al. | 72/262 |
| 4,552,520 | 11/1985 | East et al. | 425/79 |

FOREIGN PATENT DOCUMENTS

| | | | |
|---|---|---|---|
| 55-88926 | 7/1980 | Japan | 72/262 |
| 57-159213 | 10/1982 | Japan | 72/262 |
| 58-32516 | 2/1983 | Japan | 72/262 |
| 8300452 | 2/1983 | PCT Int'l Appl. | 72/262 |
| 1574604 | 9/1980 | United Kingdom | 72/262 |
| 2087301 | 5/1982 | United Kingdom | 425/79 |

*Primary Examiner*—Jay H. Woo
*Assistant Examiner*—James C. Housel
*Attorney, Agent, or Firm*—Berman, Aisenberg & Platt

[57] ABSTRACT

A continuous extrusion machine in which feedstock in particulate or comminuted form is admitted to a peripheral groove formed in a rotating wheel member, is enclosed in that groove by a cooperating shoe member, is frictionally dragged along the arcuate passageway formed by said groove and a projecting portion of said shoe member towards an abutment member carried by said shoe member, and is continuously extruded as a metal product through a die orifice disposed at the downstream end of that passageway. A cooling device is provided downstream of the abutment member. The passageway comprises (a) a primary zone extending downstream from the inlet end of the passageway, in which primary zone the particulate or comminuted feedstock is compacted, by rotation of said wheel member, to progressively eliminate voids in the advancing feedstock and so form an agglomerated mass of feedstock metal, and (b) an adjoining, substantially shorter, secondary zone disposed downstream of the primary zone and extending at least to the die orifice, in which secondary zone said mass of metal is progressively compressed, by rotation of the wheel member, to a desired extrusion pressure sufficient to extrude said mass of metal though the die orifice. The radial depth of the passageway is substantially unchanging in the primary zone, and decreases gradually in the secondary zone in the direction of rotation of the wheel member at a relatively high rate and in such manner as to produce in that zone adjacent the die orifice a metal flow pattern more closely resembling that which is achievable with feedstock in solid form.

13 Claims, 11 Drawing Figures

CONTINUOUS EXTRUSION OF METALS

The present application constitutes a continuation-in-part of the pending application Ser. No. 574,514 filed Jan. 27th 1984 by John East and Ian Maxwell, abandoned.

TECHNICAL FIELD

This invention relates to an apparatus for effecting continuous extrusion of metal from a feedstock in particulate or comminuted form, which apparatus includes:

(a) a rotatable wheel member arranged for rotation when in operation by a driving means, said wheel member having formed peripherally thereon a continuous circumferential groove;

(b) a cooperating shoe member which extends circumferentially around a substantial part of the periphery of the wheel member and which has a portion which projects in a radial direction partly into the groove with small working clearance from the side walls of the groove, said shoe member portion defining with the walls of the groove an enclosed passageway extending circumferentially of the wheel member;

(c) feedstock inlet means disposed at an inlet end of the passageway for enabling feedstock to enter the passageway at said inlet end whereby to be engaged and carried frictionally by the wheel member, when rotating, towards the opposite, outlet end of the passageway;

(d) an abutment member carried on the shoe member and projecting radially into the passageway at said outlet end thereof so as to substantially close the passageway at that end and thereby impede the passage of feedstock frictionally carried in the groove by the wheel member, thus creating an extrusion pressure in the passageway at the outlet end thereof; and (e) a die member carried on the shoe member and having a die orifice opening from the passageway at the outlet end thereof, through which orifice feedstock carried in the groove and frictionally compressed by rotation of the wheel member, when driven, is compressed and extruded in continuous form, to exit from the shoe member via an outlet aperture.

BACKGROUND ART

Where feedstock in loose particulate or comminuted form is fed directly to the inlet end of the passageway, certain disadvantages present themselves, as will be evident from the description that follows later. The present invention seeks to provide a continuous extrusion apparatus in which by appropriate means and measures those disadvantages can be at least mitigated, if not avoided.

DISCLOSURE OF THE INVENTION

According to the present invention, in an apparatus of the kind set out in the first paragraph of this specification, the passageway comprises a primary zone extending downstream from the inlet end of the passageway, in which primary zone the particulate or comminuted feedstock is compacted, by rotation of the wheel member, to progressively eliminate voids in the advancing feedstock and so form an agglomerated mass of feedstock metal, and an adjoining, substantially shorter, secondary zone disposed downstream of the primary zone and extending at least to the die orifice, in which secondary zone said mass of metal is progressively compressed, by rotation of the wheel member, to a desired extrusion pressure sufficient to extrude the mass of metal through the die orifice, the radial depth of the passageway being substantially unchanging in the primary zone, and decreasing gradually in the secondary zone in the direction of rotation of the wheel member at a relatively high rate and in such manner as to produce in that zone adjacent the die orifice a metal flow pattern more closely resembling that which is achievable with feedstock in solid form.

Preferably, the shoe member portion is constituted in the secondary zone by an insert which (a) is removably secured in the shoe member, (b) extends circumferentially upstream from the abutment member, (c) incorporates said die member, and (d) has a surface facing towards the bottom of the groove, which surface is shaped to provide said gradual decrease in radial depth of the passageway in the secondary zone.

Said surface of the insert preferably comprises a plane surface inclined at a small angle to a tangent to the bottom of the groove.

Advantageously, said plane surface is inclined at an angle such that the ratio of the area of the abutment member exposed to metal under the extrusion pressure to the radial cross-sectional area of the passageway at the upstream, entry end of the secondary zone is substantially equal to the ratio of the apparent density of the feedstock entering the secondary zone at the entry end thereof to the density of the compressed, fully compacted feedstock lying adjacent the abutment member.

In one preferred arrangement according to the present invention, said plane surface is inclined at an angle such that the said area of the abutment member exposed to the compressed metal is approximately half the radial cross-sectional area of the passageway at the entry end of the secondary zone.

Practice of the present invention results in various benefits and advantages that will be seen from a reading of the description and commentary that follow hereafter. In particular, the shaping of said surface of the shoe member portion assists in reducing (in comparison with other arrangements not incorporating the present inventive features) (a) the redundant work done on the feedstock, (b) the amount of flash produced, and (c) the bending moment imposed on the abutment member by the metal under pressure lying adjacent its upstream face.

Furthermore, the choice of a planar working surface for the said insert results in a reduction (compared to such inserts not having such a planar surface) in the cost of making that insert.

Other features and advantages of the present invention will appear from a reading of the description that follows hereafer, and from the claims appended at the end of that description.

BRIEF DESCRIPTION OF THE DRAWINGS

One continuous extrusion apparatus embodying the present invention will now be described by way of example and with reference to the accompanying diagrammatic drawings, in which.

MODES FOR CARRYING OUT THE INVENTION

Figure 1:
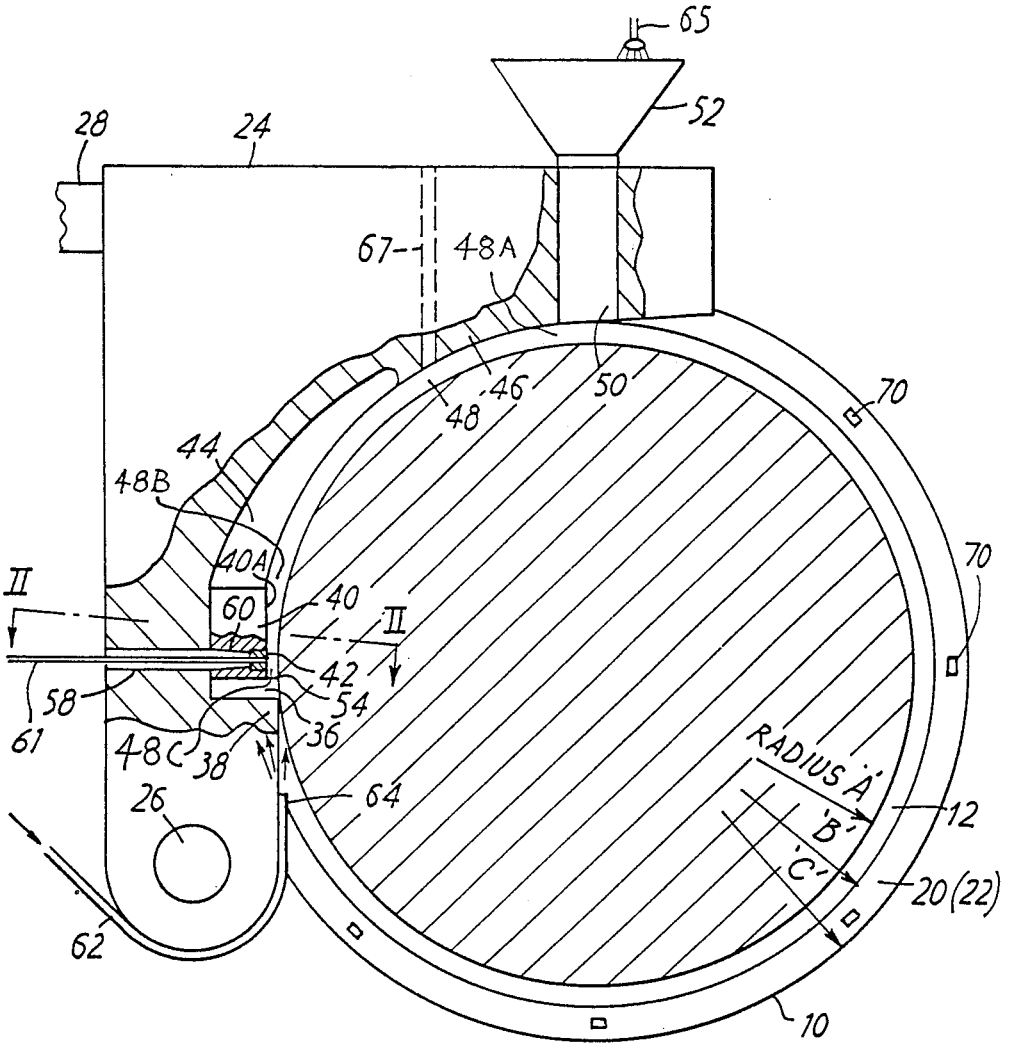
FIG. 1 shows a medial, vertical cross-section taken through the essential working parts of the apparatus, the plane of that section being indicated in FIG. 2 at I—I.
Figure 2:
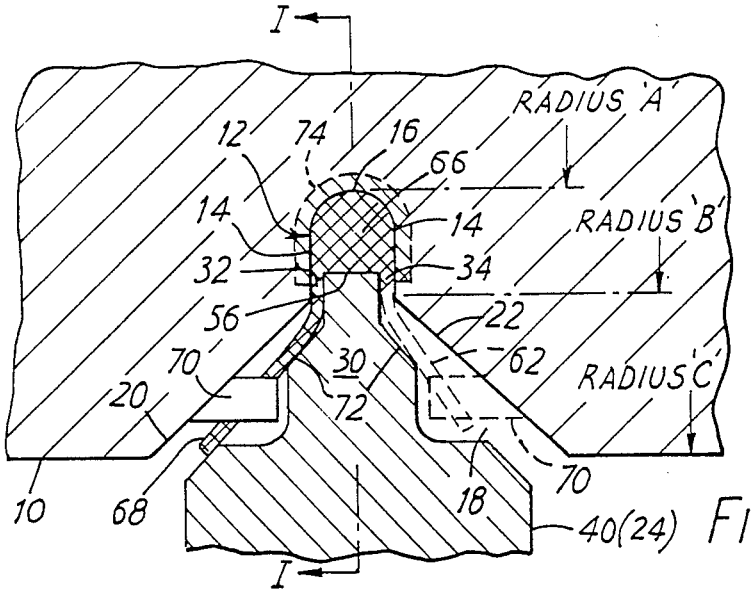
FIG. 2 shows a transverse sectional view taken on the section indicated in FIG. 1 at II—II.

Referring now to the FIGS. 1 and 2, the apparatus there shown includes a rotatable wheel member 10 which is carried in bearings (not shown) and coupled through gearing (not shown) to an electric driving motor (not shown) so as to be driven when in operation at a selected speed within the range 0 to 20 RPM (though greater speeds are possible).

The wheel member has formed around its periphery a groove 12 whose radial cross-section is depicted in FIG. 2. The deeper part of the groove has parallel annular sides 14 which merge with a radiused bottom surface 16 of the groove. A convergent mouth part 18 of said groove is defined by oppositely-directed frusto-conical surfaces 20, 22.

A stationary shoe member 24 carried on a lower pivot pin 26 extends around and cooperates closely with approximately one quarter of the periphery of the wheel member 10. The shoe member is retained in its operating position as shown in FIG. 1 by a withdrawable stop member 28.

The shoe member includes centrally (in an axial direction) a circumferentially-extending projecting portion 30 which projects partly into the groove 12 in the wheel member 10 with small axial or transverse clearance gaps 32, 34 on either side. That projecting portin 30 is constituted in part by a series of replaceable inserts, and comprises a radially-directed abutment member 36, an abutment support 38 downstream of the abutment member, a die block 40 (incorporating an extrusion die 42) upstream of the abutment member, and an arcuate wear-resisting member 44 upstream of said die block. Upstream of the member 44 an integral entry part 46 of the shoe member completes an arcuate passageway 48 which extends around the wheel member from a vertically-oriented feedstock inlet passage 50 disposed below a feedstock hopper 52, downstream as far as the front face 54 fo the abutment member 36. That passageway has a radial cross-section which in the FIG. 2 is defined by the annular side walls 14 and bottom surface 16 of the groove 12, and the inner surface 56 of the said central portion 30 of the shoe member 24.

The said abutment member 36, die block 40, die 42 and arcuate member 44 are all made of suitably hard, wear-resistant metals, e.g. high-speed tool steels.

The shoe member is provided with an outlet aperture 58 which is aligned with a corresponding aperture 60 formed in the die block 40 and through which the extruded output metal product 61 (e.g. a round wire) from the orifice of the die 42 emerges.

On rotation of the wheel member 10, comminuted feedstock admitted to the inlet end of the said arcuate passageway 48 from the hopper 52 via the inlet passage 50 is carried by the moving groove surfaces of the wheel member in a counter-clockwise direction, as seen in FIG. 1 along the length of said arcuate passageway 48, and is agglomerated and compacted to form a solid slug of metal devoid of interstices in the lower-most section of the passageway adjacent said die block 40. That slug of metal is continuously urged under great pressure against the abutment member by the frictional drag of the moving groove surfaces. That pressure is sufficient to extrude the metal of said slug through the orifice of the extrusion die and thereby provide an extruded output product which issues through the apertures 58 and 60 in the shoe member and die block. In the particular case, the output product comprises a bright copper wire produced from small chopped pieces of wire which constitute the said feedstock.

A water pipe 62 secured around the lower end of the shoe member 24 has an exit nozzle 64 positioned and secured on the side of the shoe member that lies adjacent the wheel member 10. The nozzle is aligned so as, when the pipe is supplied with cooling water, to direct a jet of water directly at the downstream parts of the abutment member where it lies in and abuts the groove 12 in the wheel member 10. Thus, the tip of the free end of the abutment member (where in operation most of the heat is generated) and the adjoining surfaces of the wheel member and groove are directly cooled by the flow thereover of water from the jet directed towards them.

The die block 40 is provided with internal water passages (not shown) and a supply of cooling water for enveloping the output product leaving the die and extracting some of the heat being carried away in that product. But no such internal passages are formed in the abutment member. Thus, the strength of that member is not reduced in the interests of providing internal water cooling for cooling that member.

If desired, the cooling of the apparatus may be enhanced by providing cooling water sprinklers 65 over the hopper 52 so as to feed some cooling water into the said arcuate passageway 48 with the comminuted feedstock.

In the FIG. 2, the slug of compacted metal in the extrusion zone adjacent the die block 40 is indicated at 66. From that metal slug, the output product is extruded through the extrusion die 42 by the pressure in that zone. That pressure also acts to extrude some of the metal through the said axial clearance gaps 32 and 34 between the side walls of the groove and the respective opposign surfaces of the die block and abutment member. That extruded metal gradually builds up in a radial direction to form strips 68 of waste metal or "flash". In order to prevent those waste strips growing too large to handle and control, a plurality of transversely-directed teeth 70 are secured on the divergent walls 20, 22 which constitute the said mouth 18 of the groove 12. Thsoe teeth are uniformly spaced around the wheel member, the teeth on one of the walls being disposed opposite the corresponding teeth on the opposite wall. If desired, the teeth on one wall may alternatively be staggered relative to corresponding teeth on the other wall.

In operation, the inclined surfaces 72 of the die block 40 deflect the extruded waste strips 68 obliquely into the paths of the respective sets of moving teeth 70. Interception of such a waste strip 68 by a moving tooth causes a piece of that strip to be cut or otherwise torn away from the extruded metal in the clearance gap. Thus, such waste extruded strips are removed as soon as they extend radially far enough to be intercepted by a moving tooth. In this way the "flash" is prevented from reaching unmanageable proportions.

The said teeth do not need to be sharp, and can be secured in any satisfatory manner on the wheel member 10, e.g. by welding.

Figure 3:
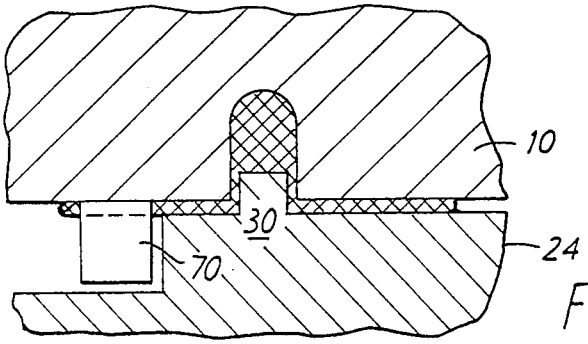
FIGS. 3 and 4 show in sectional views similar to those of FIG. 2 two arrangements which are alternatives to that of FIG. 2.
Figure 4:
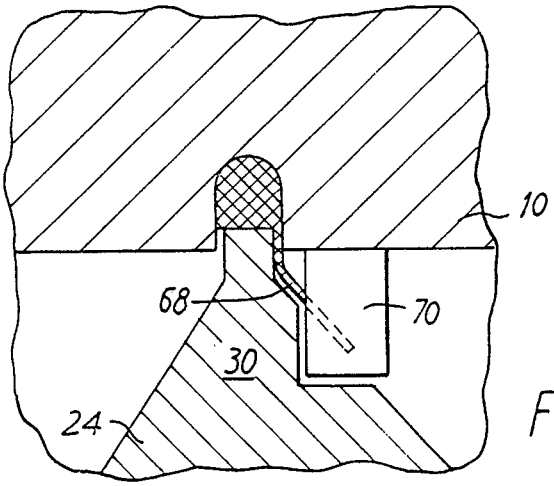

In the FIGS. 3 and 4 are shown other teeth fitted in analogous manners to appropriate surfaces of other forms of said wheel member 10.

In those alternative arrangements, the external surfaces of the wheel member 10 cooperate with correspondingly shaped surfaces of the cooperating shoe member 24 whereby to effect control of the flash in a particular desired way. In FIG. 3, the flash is caused to grow in a purely transverse or axial direction, until it is intercepted by a radially projecting tooth, whereupon that piece of flash is torn away from the extruded metal in the associated clearance gap.

In FIG. 4, the flash is caused to grown in an oblique direction (as in the case of FIG. 2), but is intercepted by teeth which project radially from the surface of the wheel member 10.

For various reasons that will appear later, it may be desirable, or even necessary, to treat the extrusion product (wire 61) issuing from the continuous extrusion apparatus described above in an extrusion product treatment apparatus before passing it to a product collection and storage means. Moreover, it may be desirable or advantageous to treat the extrusion product whilst it still remains hot from the continuous extrusion process in which it was produced.

Such a treatment apparatus may, for example, be arranged to provide the extrusion product with a better or different surface finish (for example, a drawn finish), and/or a more uniform external diameter or gauge. Such a treatment apparatus may also be used to provide, at different times, from the same continuous extrusion product, finished products of various different gauges and/or tolerances. For such purposes, the said treatment apparatus may comprise a simple drawing die through which said extrusion product is first threaded and then drawn under tension, to provide a said finished product of desired size, tolerance, and/or quality. The use of such a treatment apparatus to treat the extrusion product would enable the continuous extrusion die 42 of the continuous extrusion apparatus to be retained in service for a longer period before having to be discarded because of the excessive enlargement of its die aperture caused by wear in service. Moreover, such a treatment apparatus may have its die readily and speedily interchanged, whereby to enable an output product of a different gauge, tolerance and/or quality to be produced instead.

Figure 5:
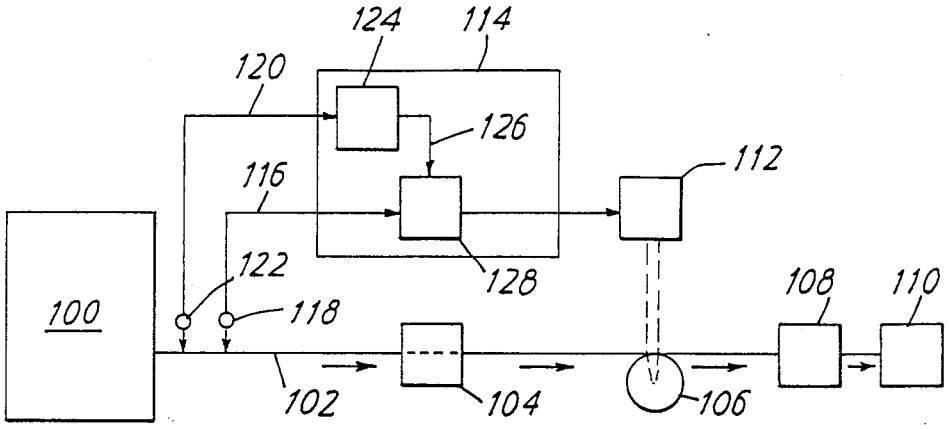
FIG. 5 shows a schematic block diagram of a system embodying the apparatus of the FIGS. 1 and 2.

One example of a continuous extrusion system incorporating a continuous extrusion apparatus and an extrusion product treatment apparatus will now be described with reference to the FIG. 5.

Referring now to the FIG. 5, the system there shown includes at reference 100 a continuous extrusion apparatus as just described above and, if desired, modified as described below, the output copper wire produced by that apparatus being indicated at 102, and being drawn through a sizing die 104 (for reducing its gauge to a desired lower value) by a tensioning pulley device 106 around which the wire passes a plurality of times before passing via an accummulator 108 to a coiler 110.

The pulley device 106 is coupled to the output shaft of an electrical torque motor 112 whose energisation is provided and controlled by a control apparatus 114. The latter is responsive to (a) a first electrical signal 116 derived from a wire tension sensor 118 which engages the wire 102 at a position between the extrusion apparatus 100 and the sizing die 104, and which provides as said first signal an electrical signal dependent on the tension in the wire 102 at the output of the extrusion apparatus 100; and to (b) a second electrical signal 120 derived from a temperature sensor 122 which measures the temperature of the wire 102 as it leaves the extrusion apparatus 100.

The control apparatus 114 incorporates a function generator 124 which is responsive to said second (temperature) signal 120 and provides at its output circuit a third electrical signal representative of the yield stress tension for the particular wire 102 when at the particular temperture represented by the said second (temperature) signal. That third electrical signal 126 is supplied as a reference signal to a comparator 128 (also part of said control apparatus) in which the said first (tension) signal 116 is compared with said third signal (yield stress tension). The output signal of the comparator constitutes the signal for controlling the energisation of the torque motor.

In operation, the torque motor is energised to an extent sufficient to maintain the tension in the wire leaving the extrusion apparatus 100 at a value which lies a predetermined amount below the yield stress tension for the particular wire at the particular temperature at which it leaves the extrusion apparatus.

Whereas in the description above reference has been made to the use of a water jet for cooling the abutment member tip, jets of other cooling liquids (or even cooling gases) could be used instead. Even jets of appropriate liquified gases may be used.

Regarding the flash-removing teeth 70 referred to in the above description, it should be noted that:

(a) the shaping of the leading edge (i.e. the cutting or tearing edge) of each tooth is not critical, as long as the desired flash removal function is fulfilled;

(b) the working clearance between the tip of each tooth 70 and the adjacent opposing surface of the stationary shoe member 24 is not critical, and is typically not greater than 1 to 2 mm, according to the specific design of the apparatus;

(c) the greater the number of teeth spaced around each side of the wheel member 10, the smaller will be the lengths of "flash" removed by each tooth;

(d) the teeth may be made of any suitable material, such as for example, tool steel; and (e) any convenient method of securing the teeth on the wheel member may be used.

The ability of the apparatus to deliver an acceptable output extrusion product from feedstock in loose particulate or comminuted form is considerably enhanced by causing the radial depth (or height) of the arcuate passageway 48, in a pressure-building zone which lies immediately ahead (i.e upstream) of the front face 54 of the abutment member 36, to diminish relatively rapidly in a preferred manner in the direction of rotation of the wheel member 10, for example in the manner illustrated in the drawings.

The removable die block 40 is arranged to be circumferentially co-extensive with that zone, and the said progressive reduction of the radial depth of the arcuate passageway is achieved by appropriately shaping the surface 40A of the die block that faces the bottom of the groove 12 in the wheel member 10.

That surface 40A of the die block is preferably shpaed in a manner such as to achieve in the said zone, when the apparatus is operating, a feedstock metal flow pattern that closely resembles that which would be achieved were feedstock in solid form being used instead. In the preferred embodiment illustrated in the drawings, that surface 40A comprises a plane surface which is inclined at a suitable small angle to a tangent to the bottom of the groove 12 at its point of contact with the abutment member 36 at its front face 54.

That angle is ideally set at a value such that the ratio of (a) the area of the abutment member 36 that is exposed to feedstock metal at the extrusion pressure, to (b) the radial cross-sectional area of the passageway 48 at the entry end of said zone (i.e. at the radial cross section adjacent the upstream end of the die block 40) is equal to the ratio of (i) the apparent density of the feedstock entering that zone at said entry end thereof, to (ii) the density of the fully-compacted feedstok lying adjacent the front face 54 of the abutment member 36.

In one satisfactory arrangement, the said plane surface 40A of the die block was inclined at an angle such that the said area of the abutment member that is exposed to feedstock metal at the extrusion pressure is equal to one half of the said radial cross-sectional area of the passageway 48 at the entry end of said zone (i.e. at the upstream end of the die block).

If desired, in an alternative embodiment the surface of the die block facing the bottom of the groove 12 may be inclined in the manner referred to above over only a greater part of its circumferential length which extends from the said upstream end of the die block, the part of the die block lying immediately adjacent the front face 54 of the abutment member being provided with a surface that lies parallel (or substantially parallel) with the bottom of the groove 12.

The greater penetration of the die block 40 into the groove 12, which results from the said shaping of the surface 40A referred to above, serves also to offer increased physical resistance to the unwanted extrusion of flash-forming metal through the clearance gaps 32 and 34, so that the amount of feedstock metal going to the formation of such flash is greatly reduced. Moreover, that penetration of the die block into the groove 12 results in reductions in (a) the redundant work done on the feedstock, (b) the amount of flash produced, and (c) the bending moment imposed on the abutment member by the metal under pressure. Furthermore, the choice of a plane working surface 40A for the die block reduces the cost of producing that die block.

Whereas in the above description, the wheel member 10 is driven by an electric driving motor, at speeds within the stated range, other like-operating continuous extrusion machines may utilise hydraulic driving means and operate at appropriate running speeds.

As an alternative to introducing additional cooling water into the passageway 48 via the sprinklers 65, hopper 52 and passage 50, such additional cooling water may be introduced into that passageway (for example, via a passage 67 formed in the shoe member 24) at a position at which said passageway is filled with particulate feedstock, but at which said particulate feedstock therein is not yet fully compacted.

It is believed that the highly beneficial cooling effects provided by the present invention arise very largely from the fact that the heat absorbed by a part of the wheel member lying temporarily adjacent the hot metal in the confined extrusion zone upstream of the abutment member is conveyed (both by thermal conduction and rotation of the wheel member) from that hot zone to a cooling zone situated downstream of the abutment member, in which cooling zone a copious supply of cooling fluid is caused to flow over relatively large areas of the wheel member passing through that cooling means so as to extract therefrom a high proportion of the heat absorbed by the wheel member in the hot extrusion zone.

In this cooling zone access to the wheel member is less restricted, and relatively large surfaces of that member are freely available for cooling purposes. This is in direct contrast to the extremely small and confined cooling surfaces that can be provided directed adjacent the extrusion zone in the parts of the said shoe member (i.e. the die block and abutment member) that bound that extrusion zone. As has been mentioned above, the cooling surfaces that can be provided in those parts are severely limited in size by the need to conserve the mechanical strengths of those parts and so enable them to safely withstand the extrusion pressure exerted on them.

The conveying of heat absorbed by the wheel member to the said cooling zone can be greatly enhanced by the incorporation in said wheel member of metals having good thermal conductivities and good specific heats (per unit volume). However, since the said wheel member, for reasons of providing adequate mechanical strength, is made of physically strong metals, (e.g. tool steels), it has relatively poor heat transmission properties. Thus, the ability of the wheel member to convey heat to said cooling zone can be greatly enhanced by incorporated intimately in said wheel member an annular band of a metal having good thermal absorption and transmission properties, for example, a band of copper.

Such a thermally conductive band may conveniently be constituted by an annular band secured in the periphery of the said wheel member and preferably constituting, at least in part, the part of said wheel member in which the said circumferential groove is formed to provide (with the shoe member) the said passageway (48).

In cases where the extrusion product of the machine is of a metal having suitably good thermal properties, the said thermally conductive band may be composed of the same metal as the extrusion product (e.g. copper).

In other cases, said thermally-conductive band may be embedded in, or be overlaid by, a second annular band, which second band is of the same metal as the extrusion product of the machine and is in contact with the tip portion of the said abutment member, the two bands being of different metals.

Metals which may be used for the said thermally-conductive band are selected to have a higher product of thermal conductivity and specific heat per unit volume than tool steel, and include the following (in decreasing order of said higher product):

Copper, silver, beryllium, gold, aluminium, tungsten, rhodium, iridium, molybdenum, ruthenium, zinc and iron.

The rate at which heat can be conveyed by such a thermally-conductive band from the extrusion zone to the cooling zone is dependent on the radial cross-sectional area of the band, and is increased by increasing that cross-sectional area. Thus, for a given cross-sectional dimension measured transversely of the circumference of the wheel member, the greater the radial depth of a said band, the greater the rate at which heat will be conveyed to the cooling zone by the wheel member.

Calculations have shown that for a said wheel member having an effective diameter of 233 mm, and a speed of rotation of 10 RPM, and a said thermally-conductive band of copper having a radial cross-section of U-shape, the rate "R" of conveying heat from the extrusion zone to the said cooling zone by the wheel member, by virtue of its rotation alone, varies in the manner shown below with variation of the radial depth or extent to which a said abutment (36) cooperating with the wheel member penetrates into that copper band, that is to say, with variation of the radial thickness "T" of the copper band that remains at the bottom of the said circumferential groove (12). These calculations were based on a said copper band having with the adjacent parts (tool steel) of the wheel member an interface of generally circular configuration as seen in a radial cross section. Hence, the radial cross-sectional area "A" of the copper band varies in a non-linear manner with the said radial thickness "T" of copper at the bottom of said groove (12).

| T (mm) | A (sq. mm) | R (kW) |
|---|---|---|
| 1.0 | 18.0 | 5.1 |
| 1.5 | 22.7 | 6.4 |
| 2.0 | 27.4 | 7.7 |
| 2.5 | 32.1 | 9.1 |
| 3.0 | 36.8 | 10.4 |

In one practical arrangement having such a wheel member and a 2 mm radial thickness T of said copper band at the bottom of said groove (12), when operating at said wheel member speed and extruding copper wire of 1.4 mm diameter at a speed of 150 meters per minute, heat was extracted from the wheel member and abutment member in said cooling zone at a rate of 10 kW by cooling water flowing at as low a rate of 4 liters per minute and providing at the surfaces to be cooled in said cooling zone a jet velocity of approximately 800 meters per minute.

This heat extraction rate indicates that heat was reaching the cooling zone at a rate of some 2.3 kW as a result of the conduction of heat through the said conductive band, the adjacent wheel member parts, and the abutment member, induced by the temperature gradient existing between the extrusion zone and the cooline zone.

This measured rate of extracting heat by the cooling water flowing in the cooling zone compares very favourably with a maximum rate of heat extraction of some 1.9 kW that has been found to be achievable by flowing cooling water in the prior art manner through internal cooling passages formed in the abutment member.

Figure 6:
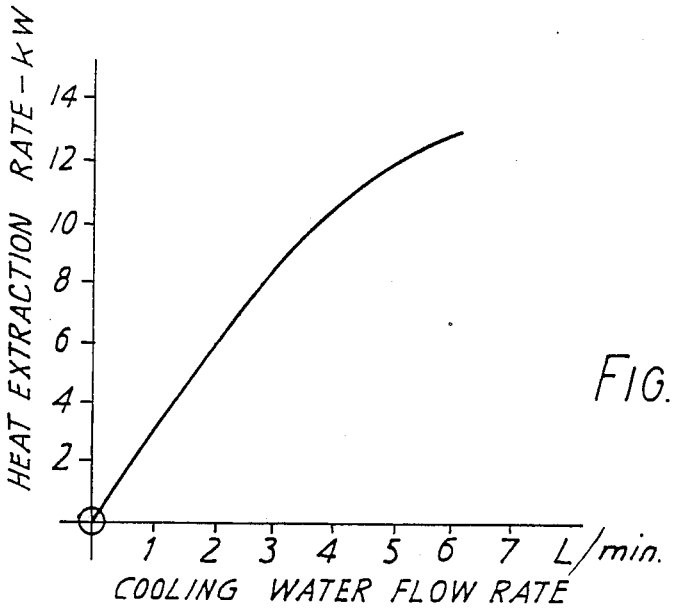
FIG. 6 shows a graph depicting the variation of a heat extraction rate with variation of a cooling water flow rated, as obtained from tests on one apparatus according to the present invention.

FIG. 6 shows the way in which the rate of extracting heat from the wheel member and abutment member in said cooling zone was found to vary with variation of the rate of flow of the cooling water supplied to that zone.

Figure 10:
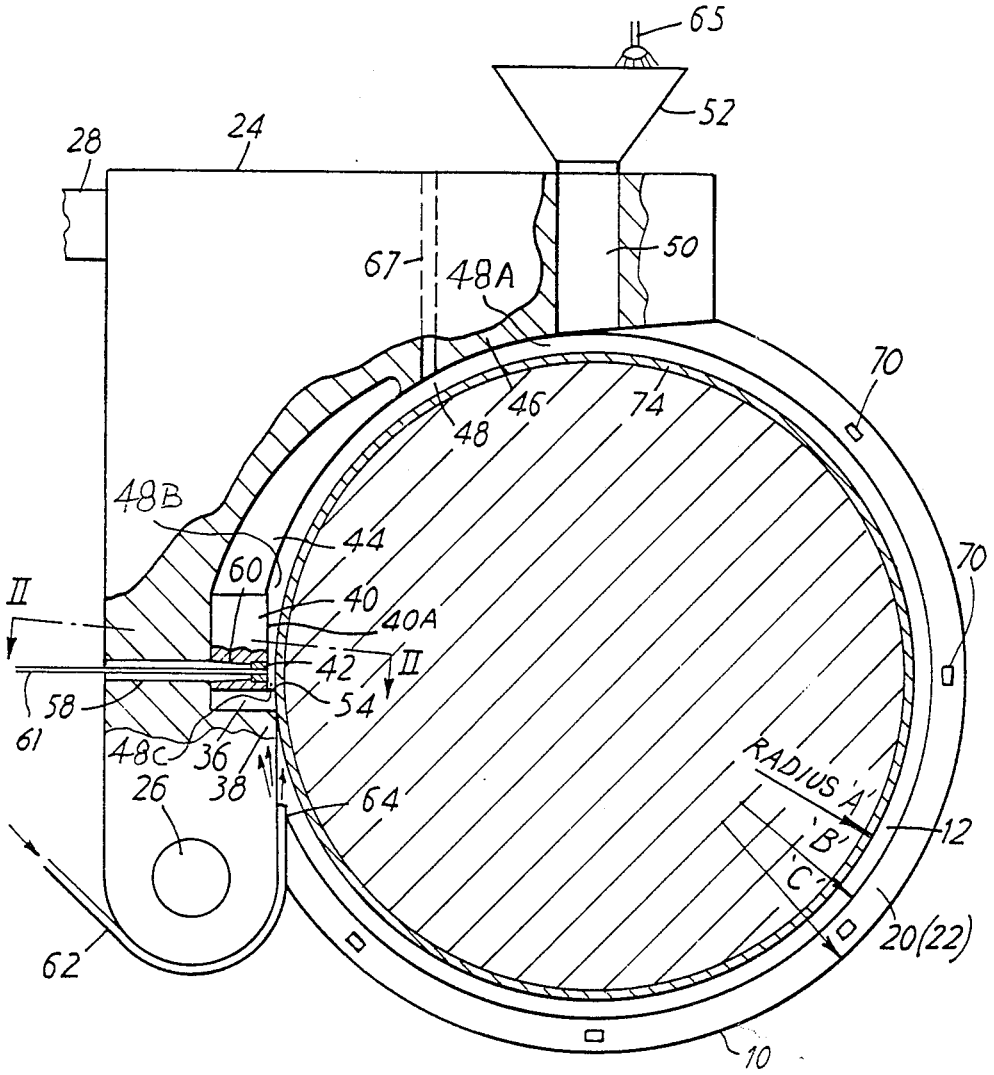
FIG. 10 shows, in a view similar to that of FIG. 1, a modified form of the apparatus shown in the FIGS. 1 and 2.

The extrusion machine described above with reference to the drawings was equipped for the practical tests with a said thermally-conductive band of copper, which band is shown at reference 74 in FIG. 10, and indicated, for convenience only, in dotted-line form in FIG. 2. (It should be noted that FIG. 2 also depicts, when the copper. band 74 is represented in full-line form, the transverse sectional view taken on the section indicated in FIG. 10 at II—II). As will be understood from reference 74 in FIG. 2, the said copper band had a radial cross section of U-shape, which band lined the rounded bottom 16 of the circumferential groove 12 and extended part-way up the parallel side walls of that groove.

Figure 7:
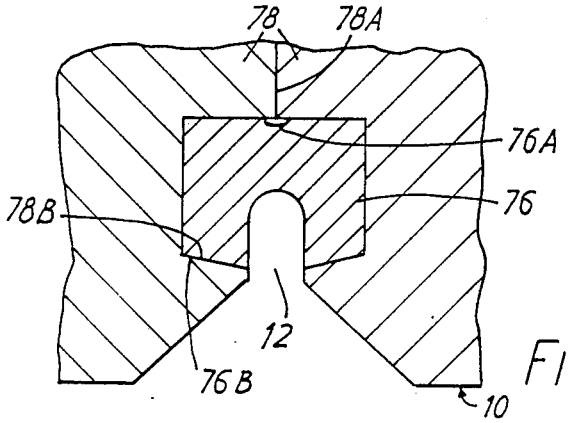

FIG. 7 shows in a view similar to that of FIG. 2 a modification of the wheel member 10. In that modification, a solid annular band 76 of copper having a substantially rectangular radial cross-section is mounted in and clamped securely between cooperating steel cheek members 78 of said wheel member, so as to be driven by said cheek members when a driving shaft on which said cheek members are carried is driven by said driving motor. The band 76 has, at least initially, a small internal groove 76A spanning the tight joint 78A between the two check members 78. That groove prevents the entry between those cheek members of any of the metal of said band 76 during assembly of the wheel member 10. Complementary frusto-conical surfaces 76B and 78B on said band and cheek members respectively permit easier assembly and disassembly of those parts of the wheel member 10.

The circumferential groove 12, is formed in the copper band by pivotally advancing the shoe member 24 about its pivot pin 26 towards the periphery of the rotating wheel member 10, so as to bring the tip of the abutment member 36 into contact with the copper band, and thereby cause it to machine the copper band progressively deeper to form said groove 12 therein.

Figure 8:
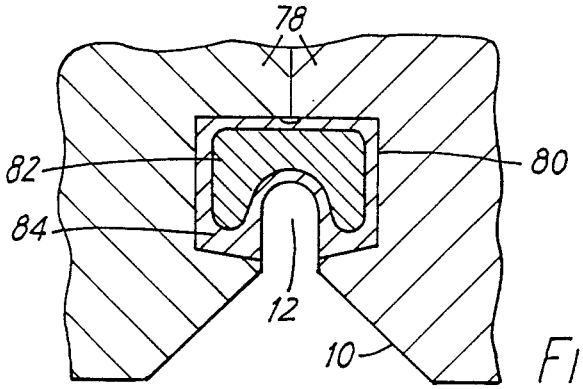

FIG. 8 shows an alternative form of said modification of FIG. 7, in which alternative the thermally-conductive band comprises instead a composite annular band 80 in which an inner core 82 of a metal (such as copper) having good thermal properties is encased in and in good thermal relationship with a sheath 84 of a metal (for example, zinc) which is the same as that to be extruded by the machine.

Figure 9:
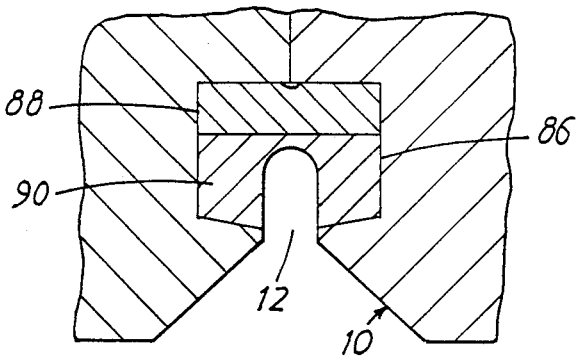
FIG. 7 to 9 show, in views similar to that of FIG. 2, various modified forms of a wheel member incorporated in said apparatus.

FIG. 9 shows a further alternative form of said modification of FIG. 7, in which alternative the thermally-conductive band comprises instead a composite band 86 in which a radially-inner annular part 88 thereof is made of a metal (such as copper) having good thermal properties and is encircled, in good thermal relationship, by a radially-outer annular part 90 of a metal which is the same as that to be extruded by the machine. Said circumferential groove is machined by said abutment member wholly within said radially-outer part 90 of said band.

Metals which can be extruded by extrusion machines as described above include:

Copper and its alloys, aluminium and its alloys, zinc, silver, and gold.

It should be noted that various aspects of the present disclosure which are not referred to in the claims below have been made the subjects of respective claims of other, copending U.S. patent applications (Ser. Nos. 574,511; 574,512; and 574,513), which likewise claim priority from the same two UK patent application Nos. 8309836 (filed 12 Apr. 1983) and 8302951 (filed 3 Feb. 1983).

COMMENTARY

The aspect of the present disclosure that is the subject of the claims appended at the end of this description will now be discussed further, and in relation to the disclosures of the specifications that were cited against and relied upon in the parent application Ser. No. 574,514 referred to above.

In the various embodiments disclosed herein, the arcuate passageway 48 comprises two portions or zones; i.e. a primary or upstream zone, which in the FIGS. 1 and 10 extends between the references 48A (adjacent the feedstock inlet passage 50) and 48B (adjacent the junction of the members 44 and 40 of the shoe member); and an adjoining, substantially shorter, secondary or downstream zone, which in the FIGS. 1 and 10 extends between the reference 48B and the reference 48C (adjacent the upstream face of the abutment member 36).

In the primary zone, the radial depth of the passageway 48 remains substantially constant or unchanging, (though if desired, it may decrease by a relatively small, insignificant amount as the reference 48B is approached). On the other hand, and by way of contrast, in the secondary zone, that radial depth progressively decreases as the abutment 36 is approached, at a relatively high rate so as (i) to subject only a relatively short portion of the periphery of the wheel member 10 to a high heat input under the high temperature that is generated in extruding the feedstock metal through the orifice of the die member 42, and so as (ii) to produce in the mass of feedstock metal adjacent the die orifice a desired metal flow pattern such as would be produced at that position in the passageway, had the feedstock comprised instead a feedstock in solid metal rod form.

During the passage of the particulate or comminuted feedstock through the said primary zone, the particles of feedstock, driven frictionally by the side and base walls of the wheel groove 12, are gradually agglomerated or compacted so as to progressively eliminate the voids that formerly spaced them apart. Thus, by the time they reach the end of that zone the feedstock particles are tightly packed together, and so form an agglomerated (but yet not void-free) mass of feedstock particles.

Whereas in this primay zone the frictional forces exerted in the feedstock particles arising from their random contact with the sides and bottom of the wheel groove 12 suffice to eliminate the voids between the particles and so agglomerate or compact the initially loose mass of particles, those frictional forces are insufficient to compress the metal constituting the feedstock particles. The heat generated in this zone is thus relatively small, so that the wheel member is not subjected to high temperatures in the primary zone, from which zone it is in any case relatively difficult to extract heat from the wheel member 10.

However, to finally compact that agglomerated mass of feedstock particles into a void-free mass of metal in readiness for its extrusion into a homogeneous extrusion product, and then to compress that metal to the requisite extrusion pressure, it is necessary to apply a relatively high compression to the advancing agglomerated metal particle mass. To that end, the radial depth of the passageway 48 is progressively decreased in the secondary zone, and at a relatively high rate.

The present Inventors have discovered that there are two desirable objectives to be achieved in the secondary zone.

FIRSTLY: It has been found by the Inventors to be relatively difficult to extract large quantities of heat from the wheel and shoe members in the region of the working passageway upstream of the abutment member, but relatively easy to extract such quantities of heat from those members in the region of that passageway immediately downstream of the abutment member, where an effective cooling means can be arranged to innundate those members with a cooling fluid. Such cooling means have been disclosed in the present specification, and also disclosed and claimed in the copending U.S. patent application Ser. No. 574,711 of the present applicants.

Thus, the inventors have concluded and confirmed by their experiments that the wheel and shoe members can be made to operate at relatively low operating temperatures by causing the final compaction of the agglomerated particle mass, arriving frm the preceding primary zone, and the subsequent compression of the void-free mass of feedstock metal to occur in a relatively short portion of the working passageway which is disposed immediately upstream of the abutment member, so that the high temperatures that are generated in the metal being compressed and extruded occur in that short zone only. Thus, the greater part of the work done in converting the feedstock metal into the extrusion product is performed in that relatively short secondary zone immediately upstream of the abutment member, and this is achieved by the inventors by reducing in that zone the radial depth of the working passageway, at a suitably high rate.

This relatively rapid compression of the feedstock metal is to be sharply contrasted with the somewhat gentle (i.e. slowly increasing) compression of the feedstock in the prior art arrangement of U.S. Pat. No. 4,054,048 (HAGERMAN), where the extrusion pressure is built up over a very ong circumferential part of the working passageway upstream of the abutment member.

SECONDLY: In the region of the die orifice, there is a shearing of the highly compressed feedstock metal at a shear boundary which defines the extremity of the mass of metal that remains stationary with the shoe member. Adjacent that stationary mass of metal there is an adjoining mass of metal which is being carried along as a result of movement of the wheel member's groove surfaces. To achieve that shearing action (which cannot be avoided) energy has to be expended, and that energy is merely converted into waste heat, which of course tends to raise the temperature of the adjoining parts of the wheel and shoe members. In order to prevent the operating temperatures of those parts from rising above a safe value, that waste heat has to be extracted from those members.

Hence, in the interests of limiting the amount of that waste heat that has to be extracted, some way of controlling the size of the shear energy that is converted into waste heat would provide considerable benefits.

The present Inventors have discovered how the size of that shear energy can be conveniently controlled, so as to reduce to a minimum the amount of waste heat that has to be extracted from the wheel and shoe members.

Figure 11:
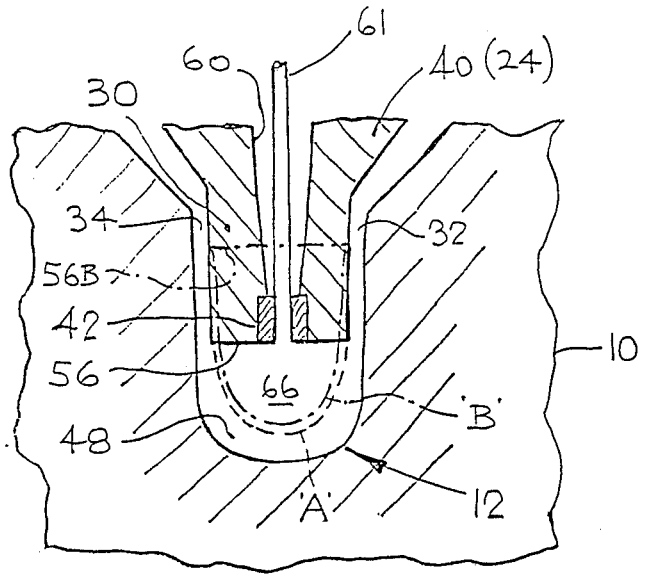
FIG. 11 shows a fragmentary sectional view taken on a radial plane of a said wheel member of the apparatus of the FIG. 1, or of the FIG. 10, which radial plane passes centrally through an extrusion die of the apparatus, and in which sectional view features disposed beyond said radial plane are not indicated for the sake of clarity.

Referring now to the diagrammatic sketch shown in the FIG. 11, there is shown there a transverse cross section of the metal-filled working passageway 48 formed between the groove 12 of the wheel member 10 and the cooperating projecting parts 30 of the die block 40 carried in the shoe member 24. That cross section comprises a radial cross section taken centrally through the die member 42, and shows the present Inventors' reduced radial depth of the passageway at the position of the die member. The metal lying adjacent the lower surface 56 of the shoe member remains stationary with the shoe member, whilst the metal lying adjacent the surfaces of wheel groove moves with those surfaces. The boundary at which shear takes place between the moving and stationary masses of metal is indicated diagrammatically by the catenary-like dotted curve designated 'A' in the sketch. the length of that shear boundary curve determines the amount of energy that must be expended to keep the moving metal in motion relative to the stationary metal.

A chain-dotted horizontal line 56B situated some way above the lower surface 56 of the projecting die block 40 indicates the position of the lower surface of the projecting shoe portion 30 in the said upstream, primary portion of the working passageway. Hence, the vertical distance separating the lines referenced 56 and 56B represents the reduction in the radial depth of the working passageway 48 that occurs in that part of the secondary zone that lies upstream of the die member 42. A second catenary-like curve 'B' shown in chain-dotted form suspended from the ends of that shoe surface 56B represents the much longer shear boundary that would have been present had the radial depth of the passageway not been reduced in accordance with the teaching of the present invention.

It will be appreciated that the length of that shear boundary 'B' is substantially greater than that of the shear boundary 'A', and that therefore the amount of energy expended in shearing the moving metal over the stationary metal at the longer shear boundary 'B' would be substantially greater than that expended at the boundary 'A'. Hence, by reducing the radial depth of the working passageway, the present Inventors have reduced by a substantial amount (i) the quantity of energy lost in simply shearing metal at the shear boundary, and hence (ii) by at least the same amount, the quantity of input energy supplied to the wheel member.

The maximum reduction in said input energy is achieved when the reduction in the radial depth of the passageway is such as to produce a metal flow pattern, in the region of the die member, which is substantially the same as that which would be produced with feedstock in solid rod form. In that condition, the cross section of the passageway adjacent the abutment member is equal to the transverse cross sectional area of the particulate feedstock material entering the secondary zone once the voids between the particles have been eliminated so as to provide instead a fully dense mass of metal.

As a result of this particular aspect of the present disclosure, the operating temperatures of the apparatus are substantially lower, and more localised, than they would otherwise be; the efficiency of the continuous extrusion process and apparatus is much better than it would other be; the extrusion of 'flash' between juxtaposed surfaces of the shoe and groove walls occurs at a much lower rate than would otherwise be obtained; and the bending moment exerted on the abutment member by the compressed metal is much less than it would otherwise be.

In contrast to friction extrusion machines arranged to handle feedstock in solid rod or bar form, the machine of the present invention is intended to handle and convert feedstock in particulate or comminuted form only. Despite allegations to the contrary, the fundamental differences in the form, properties and characteristics of the two types of feedstock material require a fundamentally different form of treatment for particulate or comminuted feedstock (as compared to that for extruding solid feedstock metal) in the working passageway of a continuous extrusion machine, if a desired end product quality is to be obtained with high efficiency. Moreover, solutions to the problems arising in the treatment of solid feedstock offer little or no significant credible guidance in relation to the solution of problems arising in the treatment of particulate feedstock. Hence, it is not rational for a man skilled in the art, when weeking solutions to problems concerning the friction extrusion of a particulate or comminuted feedstock, to take heed of and apply features already proposed in relation to the extrusion of solid rod of bar feedstock.

What is claimed is:

1. Apparatus for effecting continuous extrusion of metal from a feedstock in particulate or comminuted form, which apparatus includes:

(a) a rotatable wheel member arranged for rotation when in operation by a driving means, said wheel member has formed peripherally thereon a continuous circumferential groove;

(b) a cooperating shoe member which extends circumferentially around a substantial part of the periphery of said wheel member and which has a portion which projects in a radial direction partly into said groove with small working clearance from the side walls of said groove, said shoe member portion defining with the walls of said groove an enclosed passageway extending circumferentially of said wheel member;

(c) feedstock inlet means disposed at an inlet end of said passageway for enabling feedstock in loose particulate or comminuted form to enter said passageway at said inlet end whereby to be engaged and carried frictionally by said wheel member, when rotating, towards the opposite, outlet end of said passageway;

(d) an abutment member carried on said shoe member and projecting into said passageway at said outlet end thereof so as to substantially close said passageway at that end and thereby impede the passage of feedstock frictionally carried in said groove by said wheel member, thus creating an extrusion pressure in said passageway at said outlet end thereof;

(e) a die member carried on said shoe member and having a die orifice opening from said passageway at said outlet end thereof, through which orifice feedstock carried in said groove and frictionally compressed by rotation of said wheel member, when driven, is compressed and extruded in continuous form, to exit from said shoe member via an outlet aperture; and (f) cooling means disposed downstream from said abutment member and adapted to cool adjoining parts of said abutment, shoe and wheel members at a location disposed immediately downstream of said abutment member, and to extract from said parts heat generated upstream of said abutment member in said passageway;

said passageway comprising a primary zone extending downstream from said inlet end of said passageway, in which primary zone said particulate or comminuted feedstock is compacted, by rotation of said wheel member, to progressively eliminate voids in the advancing feedstock and so form an agglomerated mass of feedstock metal, and an adjoining, substantially shorter, secondary zone disposed downstream of said primary zone and extending at least to said die orifice, in which secondary zone said mass of metal is progressively compressed, by rotation by said wheel member, to a desired extrusion pressure sufficient to extrude said mass of metal through said die orifice, the radial depth of said passageway being substantially unchanging in said primary zone, and decreasing gradually in said secondary zone in the direction of rotation of said wheel member at a relatively high rate and in a manner such as to produce in that zone adjacent the die orifice a metal flow pattern more closely resembling that which is achievable with feedstock in solid form.

2. Apparatus according to claim 1 wherein the circumferential extent of said secondary zone is limited to that necessary to enable heat generated in said secondary zone to be extracted from said abutment, shoe and wheel member parts by said cooling means to an extent sufficient to maintain the operating temperature of the apparatus at a desired level.

3. Apparatus according to claim 2, wherein said shoe member portion is constituted in said secondary zone by an insert removably secured in said shoe member and extending circumferentially upstream from said abutment member, which insert incorporates said die member, and which insert has a surface facing towards the bottom of said groove, which surface is shaped to provide said gradual decrease in radial depth of said passageway in said secondary zone.

4. Apparatus according to claim 3, wherein said surface of said insert comprises a plane surface inclined at a small angle to a tangent to the bottom of said groove.

5. Apparatus according to claim 4, wherein said plane surface is inclined at an angle such that the ratio of the area of said abutment member exposed to metal under said extrusion pressure to the radial cross-sectional area of said passageway at the upstream, entry end of said secondary zone is substantially equal to the ratio of the apparent density of the feedstock entering said secondary zone at said entry end thereof to the density of the compressed, fully compacted feedstock lying adjacent said abutment member.

6. Apparatus according to claim 5, wherein said plane surface is inclined at an angle such that the said area of said abutment member exposed to said compressed metal is approximately half the said radial cross-sectional area of said passageway at said entry end of said secondary zone.

7. Apparatus according to claim 1 wherein the secondary zone has a length which is only a minor proportion of that of the primary zone.

8. Apparatus according to claim 2 wherein the secondary zone has a length which is only a minor proportion of that of the primary zone.

9. Apparatus according to claim 3 wherein the secondary zone has a length which is only a minor proportion of that of the primary zone.

10. Apparatus according to claim 4 wherein the secondary zone has a length which is only a minor proportion of that of the primary zone.

11. Apparatus according to claim 5 wherein the secondary zone has a length which is only a minor proportion of that of the primary zone.

12. Apparatus according to claim 6 wherein the secondary zone has a length which is only a minor proportion of that of the primary zone.

13. Apparatus according to claim 1, wherein said shoe member portion is constituted in said secondary zone by an insert removably secured in said shoe member and extending circumferentially upstream from said abutment member, which insert incorporates said die member, and which insert has a surface facing towards the bottom of said groove, which surface is shaped to provide said gradual decrease in radial depth of said passageway in said secondary zone.

* * * * *